US007444772B2

(12) United States Patent
Harasawa et al.

(10) Patent No.: US 7,444,772 B2
(45) Date of Patent: Nov. 4, 2008

(54) FLEXIBLE IMAGE DISPLAY APPARATUS

(75) Inventors: Naoki Harasawa, Tokyo (JP); Koji Nakane, Tokyo (JP); Takashi Matsumura, Tokyo (JP); Mizuki Tomono, Tokyo (JP)

(73) Assignees: Pioneer Design Corporation, Tokyo (JP); Pioneer Corporation, Tokyo (JP)

( * ) Notice: Subject to any disclaimer, the term of this patent is extended or adjusted under 35 U.S.C. 154(b) by 836 days.

(21) Appl. No.: 10/112,766

(22) Filed: Apr. 2, 2002

(65) Prior Publication Data

US 2002/0144442 A1 Oct. 10, 2002

(30) Foreign Application Priority Data

Apr. 4, 2001 (JP) ..... 2001-106011
Oct. 30, 2001 (JP) ..... 2001-332338
Dec. 28, 2001 (JP) ..... 2001-401363

(51) Int. Cl.
*G09F 21/02* (2006.01)

(52) U.S. Cl. ..... 40/586; 313/504

(58) Field of Classification Search ..... 40/586; 313/512, 511

See application file for complete search history.

(56) References Cited

U.S. PATENT DOCUMENTS 5,394,167 A 2/1995 Migny
5,722,192 A * 3/1998 Salley ..... 40/329
5,912,653 A 6/1999 Fitch
6,116,745 A * 9/2000 Yei ..... 362/105
6,229,259 B1 * 5/2001 Christensen, Sr. ..... 313/498
6,791,260 B2 * 9/2004 Komatsu et al. ..... 313/504
6,811,895 B2 * 11/2004 Murasko et al. ..... 428/690
2005/0089720 A1 * 4/2005 Imanishi ..... 428/690

FOREIGN PATENT DOCUMENTS

| | | |
|---|---|---|
| JP | 58-154877 | 9/1983 |
| JP | 5-062920 | 8/1993 |
| JP | 6-222377 | 8/1994 |
| JP | 7-098717 | 4/1995 |
| JP | 9-219288 | 8/1997 |
| JP | 11-74075 | 3/1999 |
| JP | 11-135256 | 5/1999 |
| JP | 2000-137453 | 5/2000 |
| JP | 2000-148290 | 5/2000 |
| JP | 2000-277683 | 10/2000 |
| JP | 2001-53409 | 2/2001 |
| JP | 2001-100661 | 4/2001 |
| JP | 2001-100684 | 4/2001 |
| JP | 2001-230734 | 8/2001 |
| JP | 2001-291581 | 10/2001 |
| WO | WO 9/749948 | * 12/1997 |
| WO | WO 00/16189 | 3/2000 |

OTHER PUBLICATIONS

Magazine article from "Optronics," No. 3, pp. 122-126 (2001).

* cited by examiner

*Primary Examiner*—Cassandra Davis
(74) *Attorney, Agent, or Firm*—Drinker Biddle & Reath LLP

(57) ABSTRACT

An image display apparatus is provided which comprises a flexible image display panel, and can be easily mounted on clothes. The image display panel can be easily mounted on clothes, and a drive section for driving the image display panel for displaying images is also provided.

28 Claims, 13 Drawing Sheets

FLEXIBLE IMAGE DISPLAY APPARATUS

BACKGROUND OF THE INVENTION

1. Field of the Invention

The present invention relates to an image display apparatus, and more particularly to a flexible image display apparatus which can be attached to clothes.

2. Description of the Related Art

In modern society, clothes not only protect the body but is also an important fashion component to present more attractive effects. Known fashionable clothes are those using glossy fabric, such as lame fabric.

However, even when clothes with such a glossy fabric are used, the degree of attention from onlookers decreases as time elapses.

SUMMARY OF THE INVENTION

It is an object of the present invention to provide an image display apparatus which allows maintaining attention to an individual wearing clothes for a long period of time.

It is another object of the present invention to provide an image display apparatus which can be attached to clothes.

It is another object of the present invention to provide a compact image display apparatus which can be attached to clothes.

It is still another object of the present invention to provide an image display apparatus which is not subject to the negative influence of static electricity generated from clothes, even if the image display apparatus is attached to clothes.

The image display apparatus according to the present invention comprises an image display apparatus panel, which can be attached to the fabric of clothes and can be freely bent along with the fabric, and a drive section, which is electrically connected to the image display panel and which drives the image display panel.

According to the image display apparatus of the present invention, the flexible image display panel can be attached to the fabric of clothes, and various images, such as animation, can be displayed on this image display panel, so attention to this clothing can be maintained for a long period of time. Because of the flexibility of the image display panel, integration of the clothes and the image display improves, and visual incongruity is sensed much less, where the clothes become much more fashionable.

BRIEF DESCRIPTION OF THE DRAWINGS

FIG. 6 and FIG. 7 are diagrams showing appearances of concrete examples of the image display panel shown in FIG. 5 where the drive section is built-in;

DESCRIPTION OF THE PREFERRED EMBODIMENTS

Embodiments of the present invention will now be described with reference to the accompanying drawings.

Figure 1:
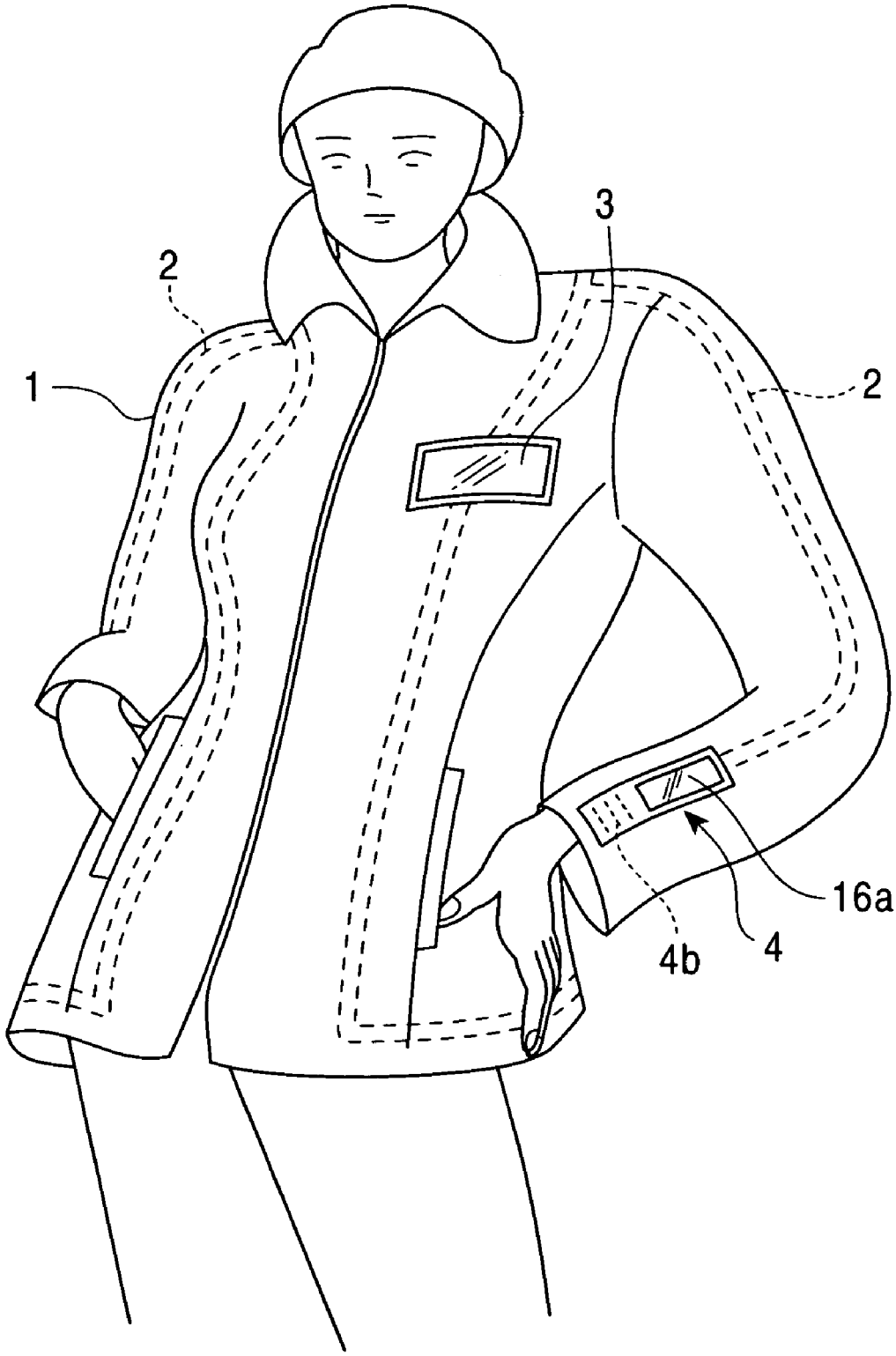
FIG. 1 is a diagram showing an appearance of an individual wearing clothes where the image display apparatus according to an embodiment of the present invention is attached.

FIG. 1 shows a view when an individual is wearing clothes with a image display apparatus according to the present invention. Cables 2 are embedded in the fabric 1 of the clothes (hereafter called fabric). Panel connection connectors are connected to the cables 2 and are set at the chest section and sleeve sections of the material, and the image display panels 3 and 4 are connected to these connectors. The image display panels 3 and 4 are flexible, and, for example, the image display panel is comprised of the organic electro-luminescent elements shown on pages 122-126 of the magazine of Optronics (2001), No. 3. The image display panel 4 includes a display screen 4*a* and a control section 4*b*. An operator can execute various operation modes by handling the input keys of the control section 4*b*. Various moving pictures and still pictures can be displayed on the display screen 4*a*. The cables 2 are not limited to the form embedded inside the fiber layer of the fabric 1, but may be attached to the surface of the fabric 1 using clips or other means. The cables 2 are connected to the power supply terminal and to the image information input/output terminals (not illustrated) of the image display panels 3 and 4 via connectors. The cables 2 can be installed at various locations of the fabric 1, and are not restricted to the form shown in FIG. 1.

It is preferable that the image display panels 3 and 4 can be removed from the fabric 1 by disconnecting the connectors. This makes it easier to wash the clothes.

Figure 2:
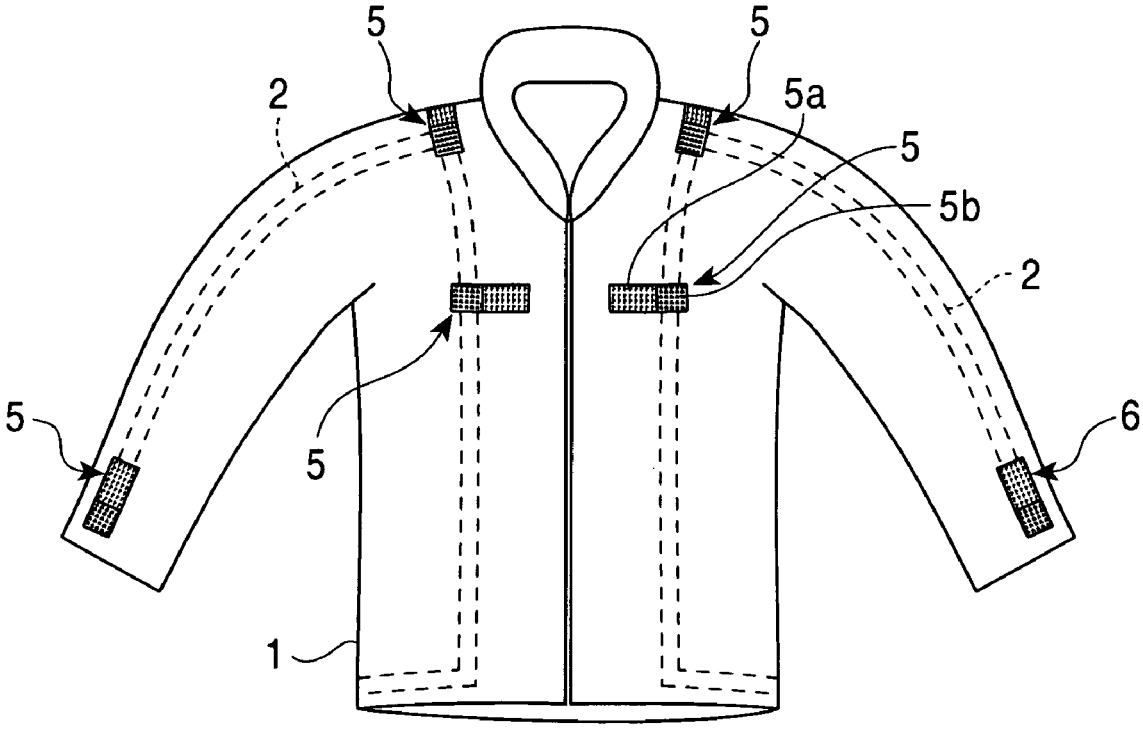
FIG. 2 is a diagram showing an appearance of the clothes shown in FIG. 1 when the image display apparatus is removed.

FIG. 2 shows the form of the clothes when the image display panels 3 and 4 are removed. In other words, the panel connection connectors 5 and 6 for each image display panel 3 and 4 are mounted at appropriate locations on the fabric 1. The panel connection connector 5 is comprised of a mechanical coupling section made of an attachment element, such as Velcro®, for mechanically holding the image display panel 3 and the electrical coupling section 5*b* for relaying signals between the image display panel 3 and the cable 2. This is also the same as for the panel connection connector 6. The panel connection connector as illustrated may be attached not only to the chest and sleeve sections of the fabric 1, but also to other appropriate locations, such as on the back. In this way, the location to attach the image display can be changed or the number of image display panels can be increased according to the use of the clothes.

Figure 3A:
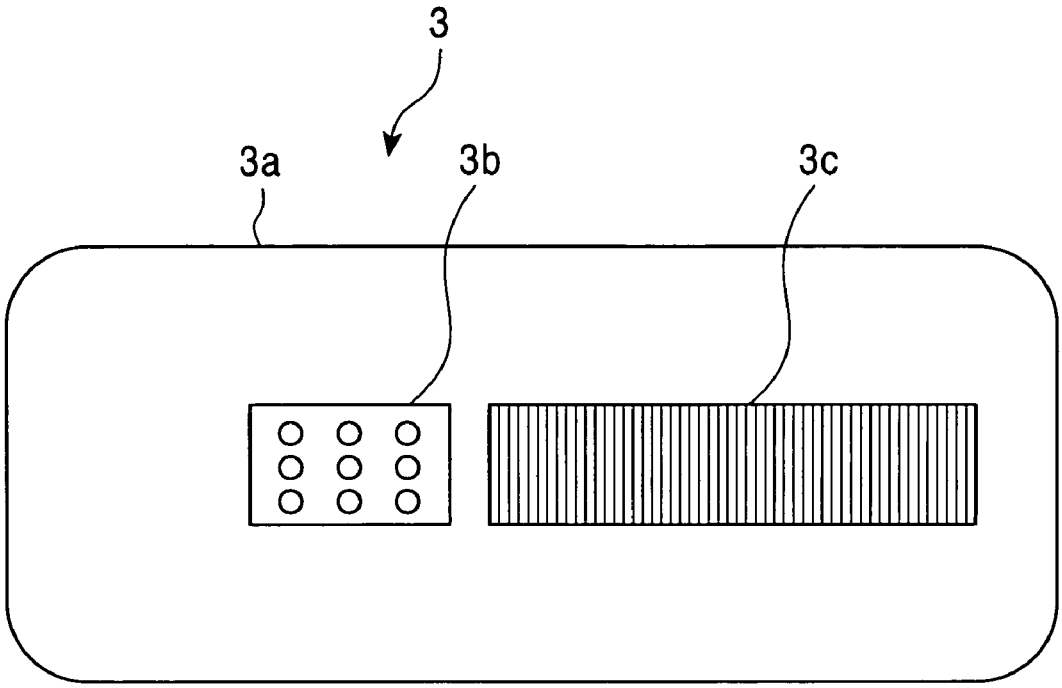
FIG. 3A is a rear view of the display panel included in the display apparatus in FIG. 1.
Figure 3B:
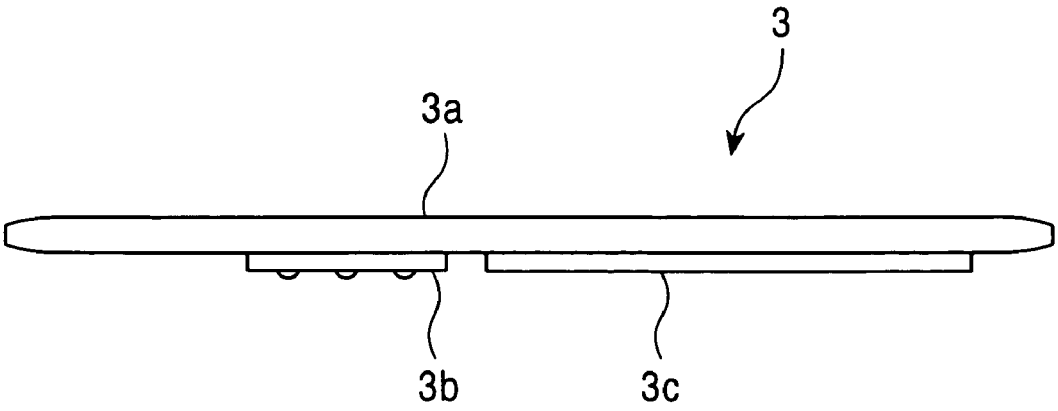
FIG. 3B is a side view of the display panel shown in FIG. 3A.

FIG. 3 shows the structure of the image display panel 3 when removed from the clothes of the present invention shown in FIG. 1.

The image display panel 3 is completely housed in a plastic housing 3*a*, and the electrical coupling part 3*b* and the mechanical coupling part 3*c* are installed on the rear face of the housing 3*a*. The mechanical coupling section 3*c* is made of an attachable element, such as Velcro®, so that the image display panel 3 can be attached to the clothes 1 by attaching [the mechanical coupling section 3*c*] with the mechanical coupling section 5*a* on the fabric 1 shown in FIG. 2. The electrical coupling section 3*b* can be connected via the connector with the electrical coupling section 5*b* on the fabric 1 shown in FIG. 2.

The mechanical coupling section and the electrical coupling section are not limited to those shown in FIG. 2 and FIG. 3, but various coupling formats are possible for the electrical connection of the image display panels 3 and 4 to the cable and mechanical connection thereof on the fabric.

As FIG. 2 shows, the panel connection connectors 5 and 6 are installed on both shoulders, on both sides of the chest, and on both sleeves of the fabric 1, but are not restricted to these locations, and can be installed at various locations according to a desired fashion. A light emitting panel can be attached to various locations for various applications, for example, if the clothing, where the light emitting panel is attached to the sleeves, is used at a work site, work can proceed while displaying the work procedure on the light emitting panel. If the light emitting panel is attached to the rear face of the clothes, an advertising image can be displayed and the clothes itself can be used as an advertisement medium.

Figure 4:
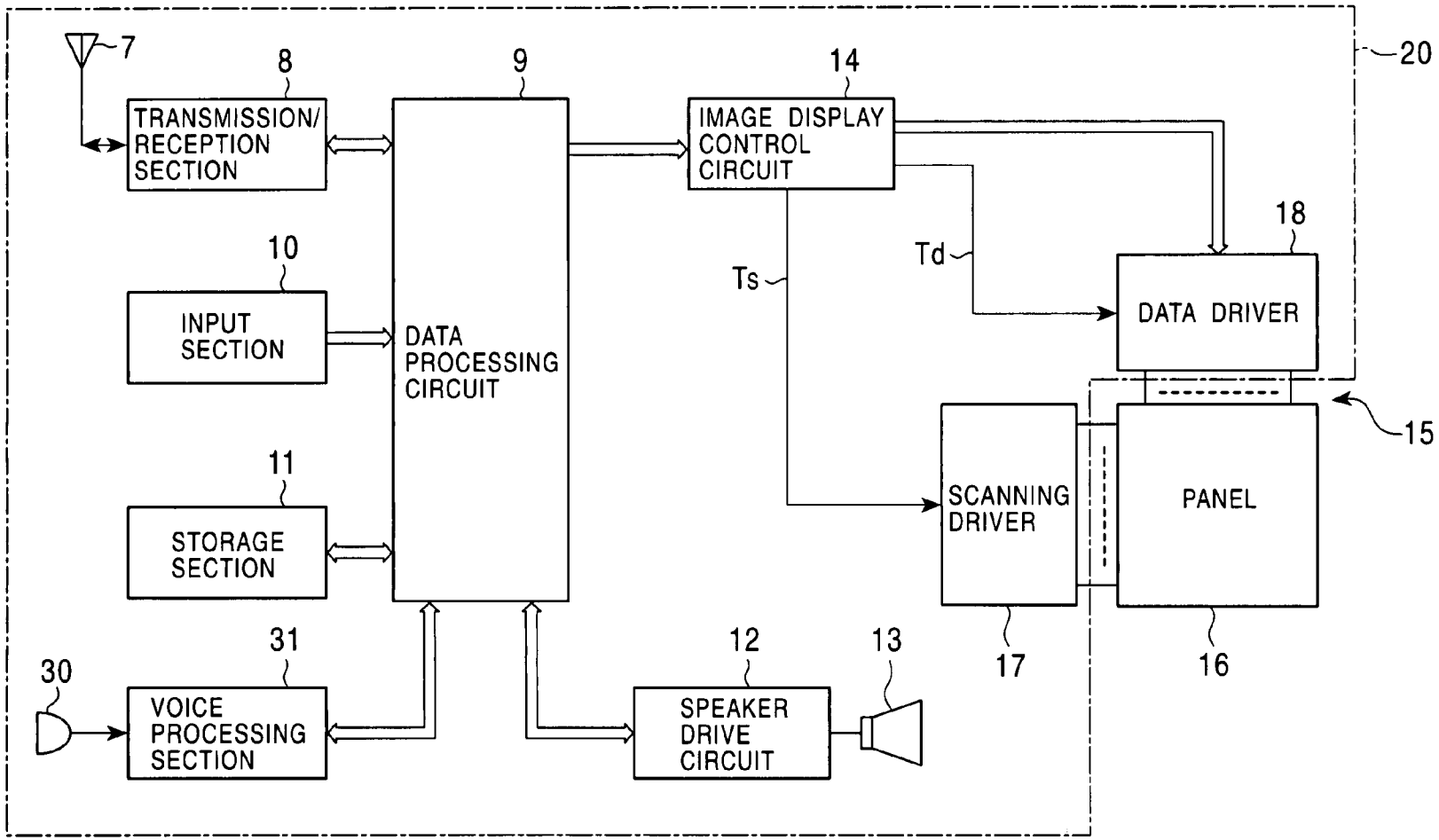
FIG. 4 is a circuit block diagram depicting the electric configuration of the image display apparatus shown in FIG. 1.

FIG. 4 shows an image display panel and a drive unit for driving this image display panel.

In this drive unit, a transmission and reception section 8 transmits and receives communication signals via an antenna 7. The transmission and reception section 8 transmits transmission and reception data to and from a data processing circuit 9. An input section 10, which is comprised of such an input unit as a keyboard, sends instruction signals to the data processing circuit 9 thereby cause the circuit 9 to execute various operation modes. A storage section 11, for which a CD-ROM or an IC card is used as a storage medium, for example, can read data stored on the CD-ROM or IC card and send the data to the data processing circuit 9, or can write the data sent from the data processing circuit 9 to the CD-ROM or IC card. As shown in FIG. 4, a speaker drive circuit 12 may be installed so that if the content of the reception data received from the transmission and reception section 8 is voice data, the voice data is transferred to a speaker drive circuit 12 where the voice data is converted to analog signals, and is then sent to a speaker 13 to reproduce the voice. In this way the drive unit, including the light emitting panel, can be used as a portable telephone. And voice can be reproduced by connecting a headphone instead of the speaker 13.

The image display control circuit 14 receives the image data along with the synchronizing signals in response to the operation command from the data processing circuit 9, and controls the image display section 15, including a panel body 16, to display images. The panel body 16 is a flexible panel. When the panel body 16 is formed by an organic electroluminescence panel, for example, the panel body 16 includes a transparent resin substrate on which a light emitting layer such as an organic electro-luminescence layer is formed. A group of data electrodes and a group of scanning electrodes cross each other, while sandwiching the light emitting layer. To these electrode groups are connected a scanning driver 17 and a data driver 18 so as to cause the light emitting layer to emit at the intersections of the electrode groups as pixels by sequentially applying voltage across the intersections. The scanning driver 17 functions as a scanning driver which sequentially applies scanning pulses to each electrode of the scanning electrodes while synchronizing with the scanning trigger pulse Ts which is supplied from the image display control circuit 14. The drive data, in addition to the data trigger pulse Td, is supplied from the image display control circuit 14 to the data driver 18. The drive data is supplied to the data driver 18 for each one line image data corresponding to each scanning line. The data driver 18 supplies voltage or current corresponding to one line image data, which is supplied in synchronism with the data trigger pulse Td, to each data electrode of the data electrode group.

It is possible to form an integral image display panel by integrating the image display panel 16 and the driving part for driving the panel 16. The driving part is comprised of transmission and reception section 8, data processing circuit 9, input section 10, and image display control circuit 14. The driving part may be formed in the form of a flexible IC which is combined with the flexible display panel body 16, so that a flexible image display panel can be created. The antenna 7 and the transmission and reception section 8 can be connected via the cable 2. Only the image display section 15, including the panel body 16, may comprise the image display panel, and a circuit, such as a processing circuit 9, and the image display panel, can be connected via the cable 2.

It is not always necessary to install the antenna 7, transmission and reception section 8 and the input section 10, and some images may be displayed using only image data stored in the storage section 11.

It is also possible to install a voice processing section 31 for converting the voice signal, acquired by a microphone 30 disposed at an appropriate location, into voice data.

Figure 5:
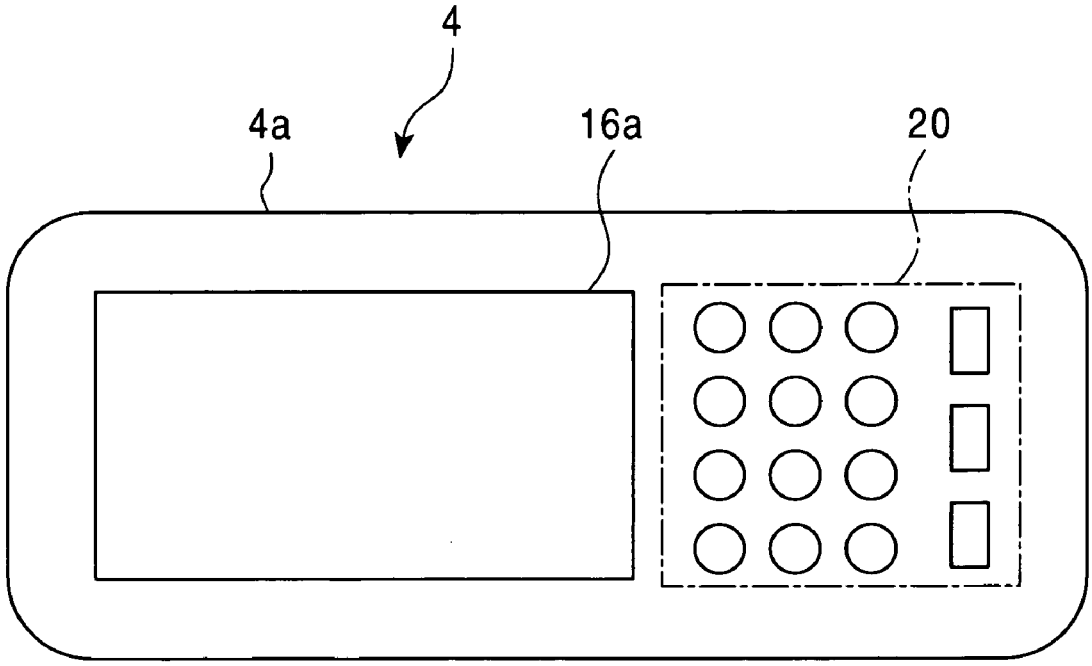
FIG. 5 is a plan view of the image display panel where a drive circuit is a built-in type.

FIG. 5 shows a configuration example of the image display panel 4 where a drive section is built-in.

As FIG. 5 shows, the input section 10 and the screen 16*a* of the display panel 16 are on the front face side of the flexible plastic housing 4*a* of the image display panel 4. A flexible IC of the drive section, which includes the data processing circuit 9, storage section 10, image display control circuit 14, scanning driver 17, data driver 18, and voice processing section 30, is embedded inside the housing 4*a*.

It is also possible for a plurality of image display panels to share the antenna 7 via the cable 2.

Electric power may be supplied to the drive unit of the image display panel via the cable 2 by installing such a flexible power supply unit as a thin polymer battery and film type solar cell on the fabric 1.

Figure 6:
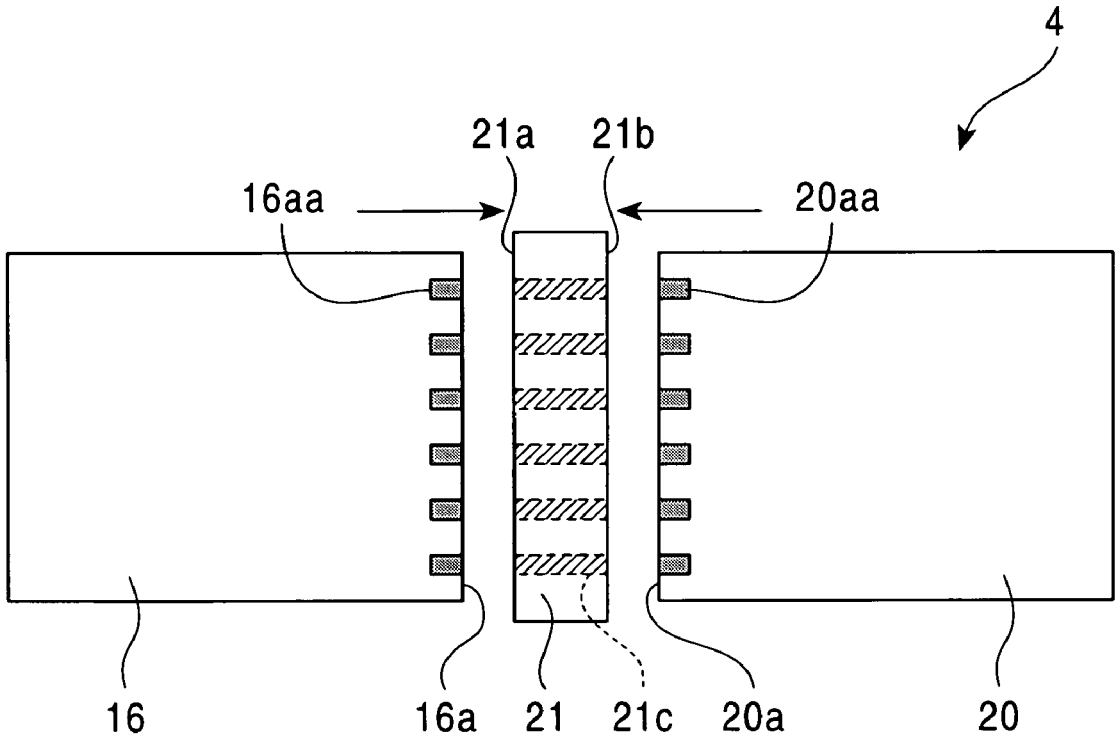

FIG. 6 shows an image display panel 4 where the display panel 16 and the drive section 20 for driving the display panel 16 are mechanically and electrically integrated by the electric connector 21. The electric connector 21, which has a rectangular parallelepiped shape, is made of synthetic resin, for example, wherein the plug edges 16*a* and 20*a* of the display panel 16 and the drive section 20 are received by the jack edges 21*a* and 21*b* respectively. A plurality of conductive thin film strips 21*c* are placed in parallel on the inner walls of the jack edges 21*a* and 21*b*, so that the conductive thin film strips 21*c* contact the plurality of conductive pads 16*aa* and 20*aa* which are disposed in each plug edge 16*a* and 20*b*, and the conductive pads 16*aa* and 20*aa* of the plug edges 16*a* and 20*b* are electrically connected when the plug edges 16*a* and 20*a* are inserted into the openings of the jack edges 21*a* and 21*b*. The conductive pads 16*aa* of the plug edge 16*a* are connected with the scanning line terminal and the data line terminal of the display panel 16, and the conductive pads 20*aa* of the plug edge 20*a* of the drive section 20 are connected with the output terminal of the scanning driver 17 and the output terminal of the data driver 18.

By creating the display panel 16 to be a flexible flat panel using organic EL elements, for example, and creating the drive section 20 using a flexible sheet type IC, such as a flexible IC according to the above configuration, the display panel 16 and the drive section 20 can be assembled to be a flexible sheet unit. When, in this case this unit is attached to clothing, this unit has no negative influence on clothing comfort and on ease of operation when the clothing is worn. The flexible flat panel 16 and the flexible drive circuit 20 can be manufactured in separate processes.

Needless to say, it is preferable that the electric connector 21 is also flexible.

Figure 7:
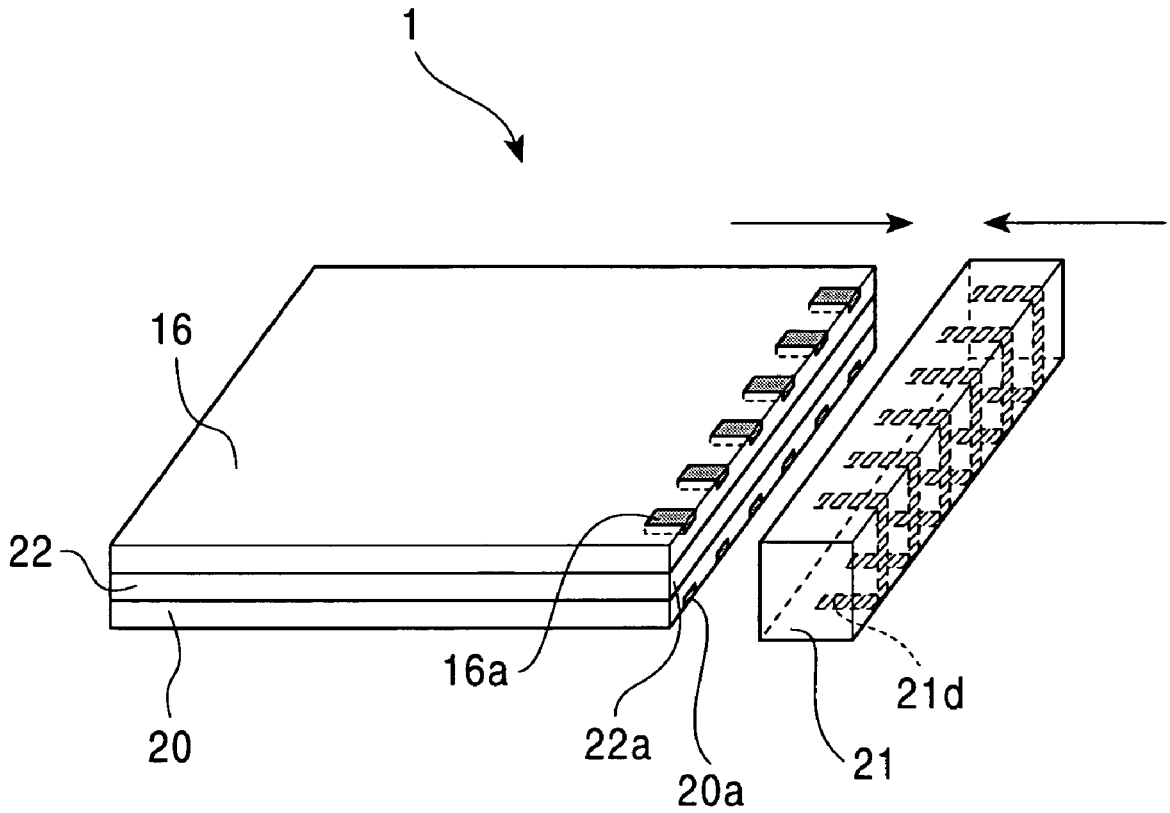

FIG. 7 shows an example in which the flexible display panel 16 and the flexible drive circuit 20 are bonded for connection via a flexible spacer 22. In this case, the plug section 16*a* of the display panel 16 and the plug section 20*a* of the drive section 20 are disposed at locations which face each other, sandwiching the edge 22*a* of the spacer 22, so that the corresponding conductive pads 16*aa* and 20*aa* of the plug section 16*a* and 20*a* are electrically connected by the electric connector 21, which has a plurality of conductive short strips 21*d* located on the inner wall of the concave sections to be coupled with the plug section 16*a* and 20*a* at the spacer 22*a*.

Figure 8A:
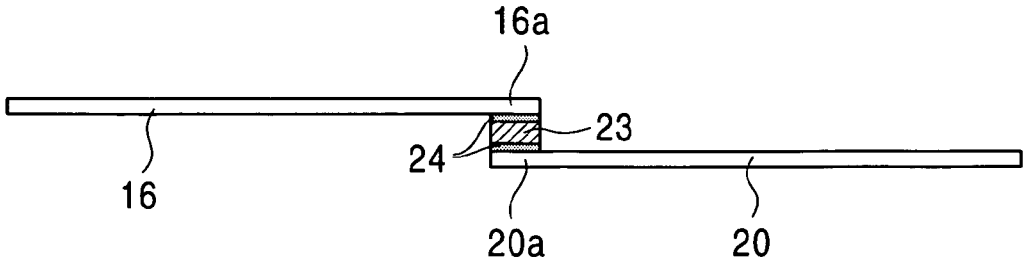
FIG. 8A through FIG. 9B are cross-sectional views of the built-in type image display panel which are constructed in forms different from those shown in FIG. 6 and FIG. 7.

FIG. 8A shows an example in which the plug section 16*a* of the flexible display panel 16 and the plug section 20*a* of the flexible drive circuit 20 are connected by gluing the conductive film 23 thereon using an adhesive. 24. The conductive film 23 can be created by plastic material where the conductive particles are dispersed. For the adhesive 24, an adhesive composed of epoxy resin or phenol resin and a hardening agent, as well as conductive particles, as stated in Japanese Patent Kokai No. 2000-277683, and Japanese Patent Kokai No. 6-222377, can be used.

Figure 8B:
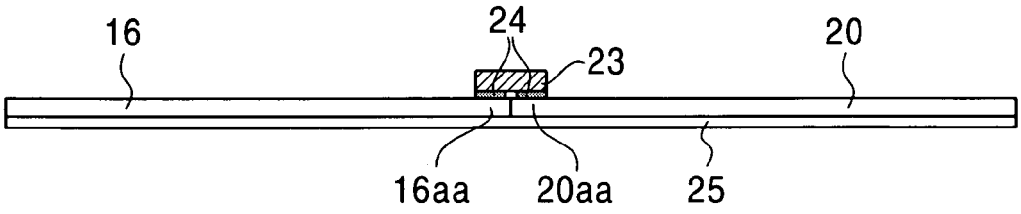

FIG. 8B shows an example in which the flexible display panel 16 and the flexible drive circuit 20 are arranged side by side on the support plate 25, and the plug section 16*a* of the display panel 16 and the plug section 20*a* of the flexible drive circuit 20 are arranged side by side on which the conductive film 23 is glued by the adhesive 24. Here, the display panel 16 and the drive circuit 20 can be supported by a common circuit board without using a support plate such as the support plate 25.

Figure 8C:
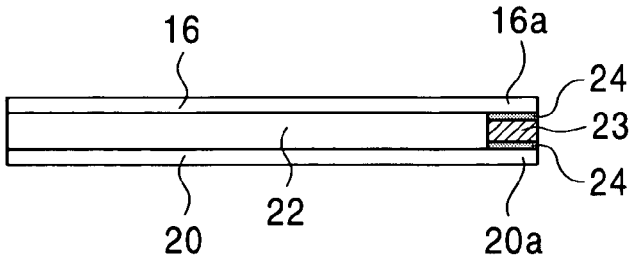

FIG. 8C shows an example in which the flexible display panel 16 and the flexible drive circuit 20 are bonded via the spacer 22 so that the plug sections 16*a* and 20*a* face each other. The plug sections 16*a* and 20*a* are electrically connected to each other via the conductive film 23 by using the adhesive 24.

Figure 8D:
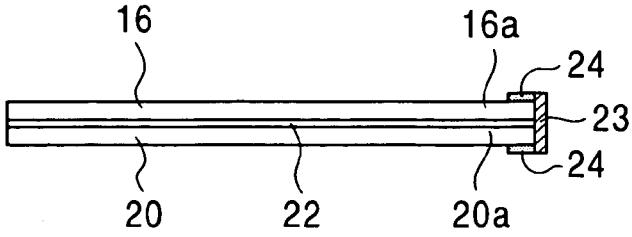

The form shown in FIG. 8D is the same as the form in FIG. 8C, except that the conductive film 23 is glued to the side faces of the plug sections 16*a* and 20*a* by using the adhesive 24.

Figure 9A:
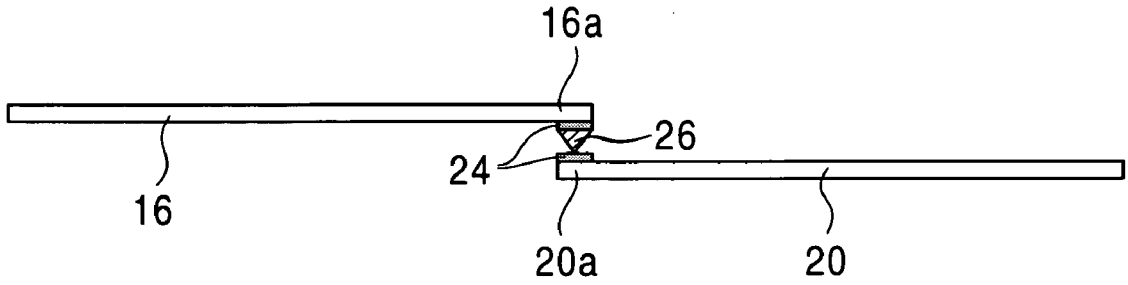

The form shown in FIG. 9A is the same as the form shown in FIG. 8A, except that the plug sections 16*a* and 20*a* are coupled to each other via the bump 26 instead of the conductive film 23 using the adhesive 24. Here the bump 26 is protrusions made of such conductive material as solder, and is disclosed in Japanese Patent Kokai No. 2001-53409, for example.

Figure 9B:
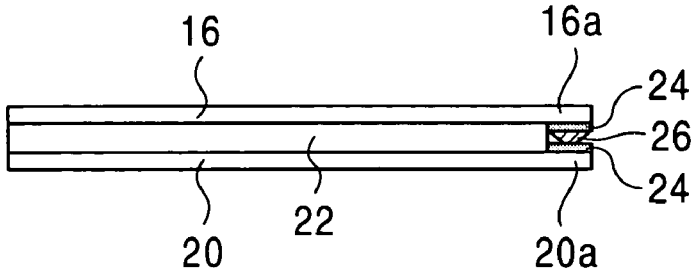

The form shown in FIG. 9B is the same as the form shown in FIG. 8B, except that the plug sections 16*a* and 20*a* are coupled to each other via the bump 26 instead of the conductive film 23 using the adhesive 24.

The above mentioned display panel 16 and the drive circuit 20 are both flexible and are coupled to be integrated, and so a cable to connect them is unnecessary, and a compact image display can be obtained at a low cost.

The image display apparatus to the present invention can be attached not only to a clothing but also to curtains or walls, and can be used as an image display for a clock, poster, bulletin board, business card, advertisement medium, electronic pocket notebook, personal computer, and TV.

Figure 10:
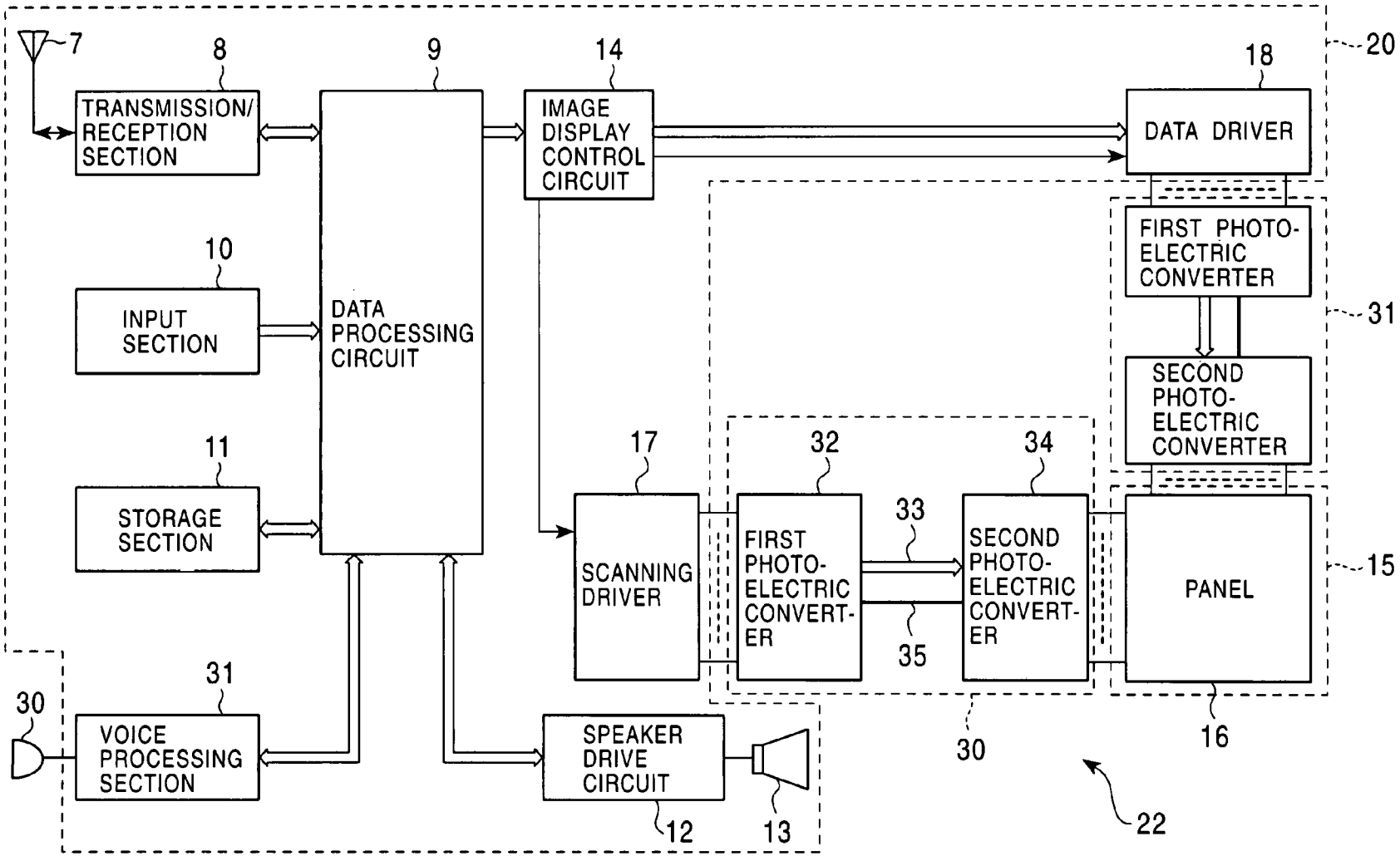
FIG. 10 is a block diagram depicting the image display where the drive section 20 and the image display section 15 are connected by optical cables.

FIG. 10 shows an image display apparatus where the display section 15, including the display panel 16, and the drive section 20, are connected by one or more optical cables.

In other words, in this image display, the scanning driver 17 and the data driver 18 of the drive circuit 20 are connected to the scanning input terminal and the data input terminal of the display panel 16 respectively via the optical cable units 30 and 31.

The optical cable unit 30 includes a first photo-electric converter 32 which converts the parallel pulse signals from the output terminal of the scanning driver 17 into a serial electric pulse signal train, then generates an optical or light pulse train corresponding to the electric pulse train. The light pulse train from the first photo-electric converter 32 is supplied to a second photo-electric converter 34 by the optical cable 32. The second photo-electric converter 34 converts the input light pulse train into parallel electric pulse signals, and supplies them to the scanning terminal of the display panel 16. With such arrangement, light pulses which travel on optical cable are not influenced by the static electricity generated because of the friction of clothing. An earth wire 35, made of such a conductor as carbon fibers, is positioned to contact the optical cable 32, so that the optical cable 33 is not charged even if static electricity is generated on the clothes. As a result, little noise is generated to the signals to be supplied to the display panel 16.

FIG. 11A to FIG. 11F show examples of assemblies when the optical cable 33 and the earth wire 35 are combined. In other words, the optical cable 33 and the earth wire 35 exist in a state where the optical cable 33 and the earth wire 35 contact each other housed in a common sheath element 37.

Figure 11A:
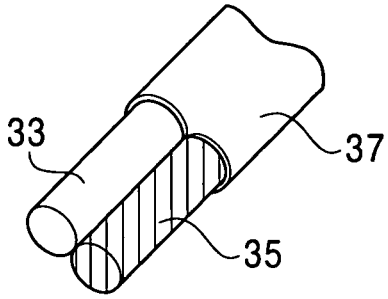
FIG. 11A to FIG. 11F are perspective views depicting various forms of optical cables according to the present invention.

In the example shown in FIG. 11A, the optical cable 33 and the earth wire 35 are positioned in parallel and contacted with each other, where the optical cable 33 and the earth wire 35 are housed in one sheath element 37.

Figure 11D:
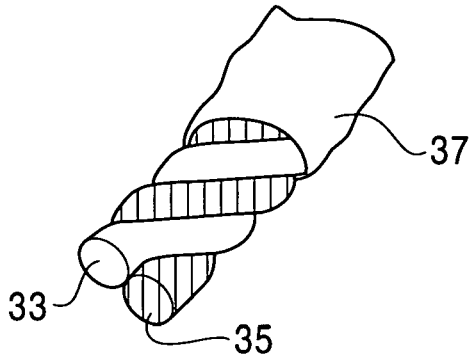
Figure 11B:
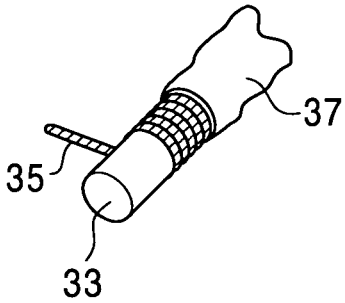

In the example shown in FIG. 11B, the earth wire 35 is coiled around the optical cable 33, and are covered with the sheath element 37.

Figure 11E:
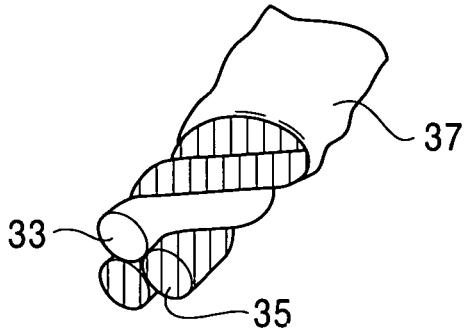
Figure 11C:
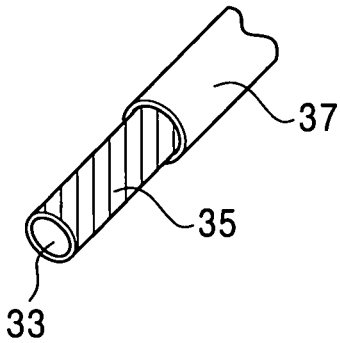

In the example shown in FIG. 11C, the optical cable 33 is surrounded by a cylindrical earth wire 35, which are further covered with the sheath element 37.

In the example shown in FIG. 11D, the optical cable 33 and the earth wire 35 are twisted one-to-one, and are covered with the sheath element 37.

In the example shown in FIG. 11E, the optical cable 33 and the earth wire 35 are twisted one-to-two, and are covered with the sheath element 37.

Figure 11F:
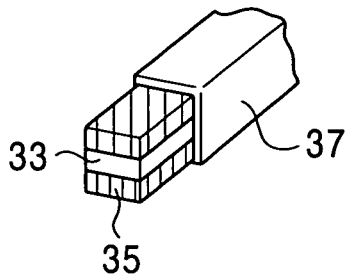

In the example shown in FIG. 11F, a pair of earth wires 35 sandwich one optical cable 33, and are covered with the sheath element 37.

Figure 12:
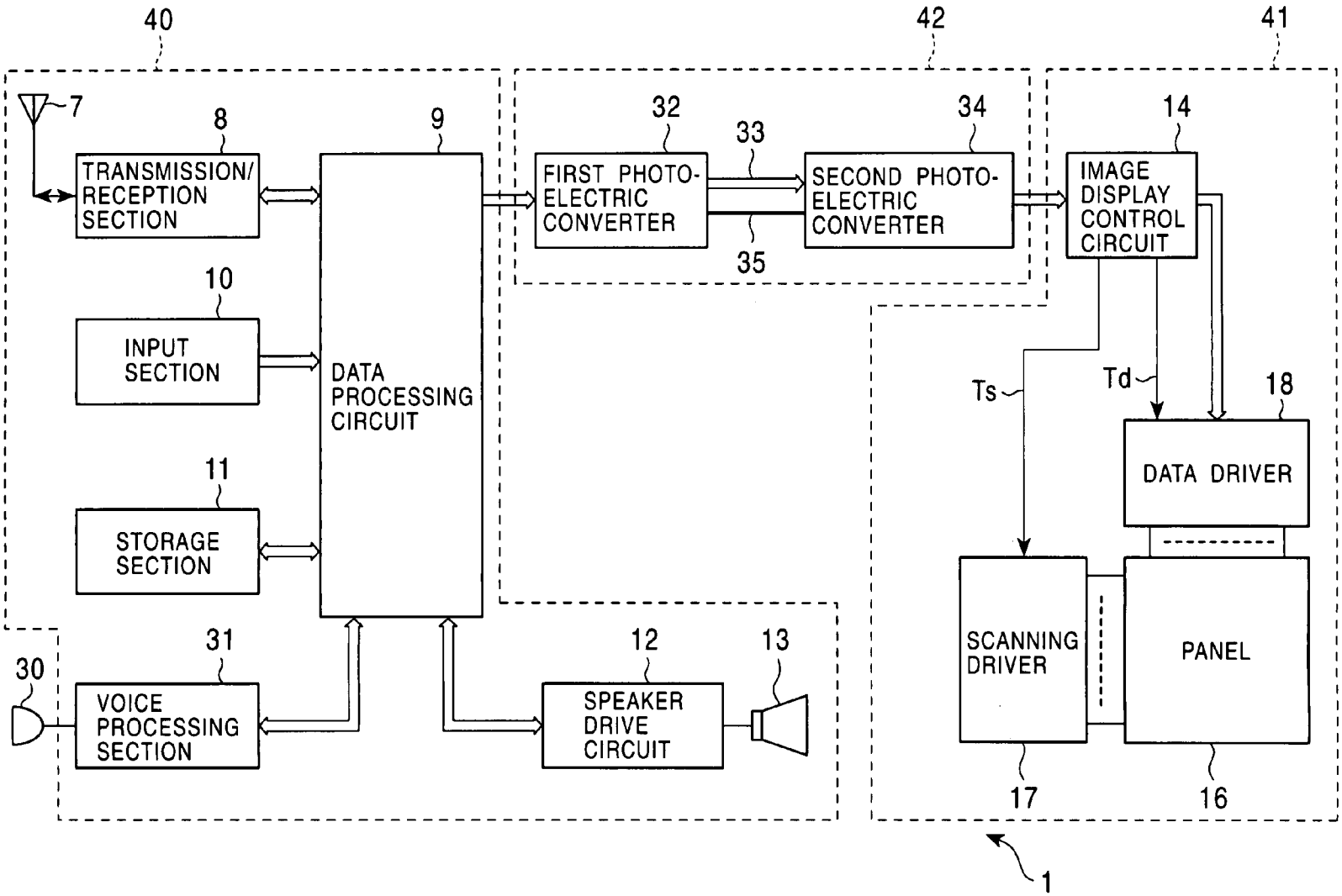
FIG. 12 is a block diagram depicting a circuit where the image display drive section is separated into the signal processing section 40 and the control drive section 41 which are connected by optical cables.

In FIG. 12, unlike the example in FIG. 10, an image display section 41 is comprised of the display panel 16, image display control circuit 14 which controls and drives the display panel 16, scanning driver 17, and data driver 18. And the image data signal generation section 40 for generating and supplying the image data signals to be supplied to the image display control circuit 14 is comprised of an antenna 7, transmission and reception section 8, data processing circuit 9, input section 10, storage section 11, speaker drive circuit 12, speaker 13, microphone 30, and voice processing circuit 31. The image data signal generation section 40 and the image display section 41 are connected by the signal relay section 42 including the optical cable 33. The signal relay section 42 has the same form as the optical cable unit 30 in the circuit example in FIG. 10.

By this configuration, the image display section 41 is installed at an appropriate location on clothes, and the image data signal generation section 40 is positioned near the hip positions of the individual wearing the clothes where the optical cable 33 of the signal relay section 42 and the earth wire 35, which is placed along with [the optical cable 33], are placed on the clothes such that the image display section 41 and the image data signal generation section 40 are connected.

Figure 13:
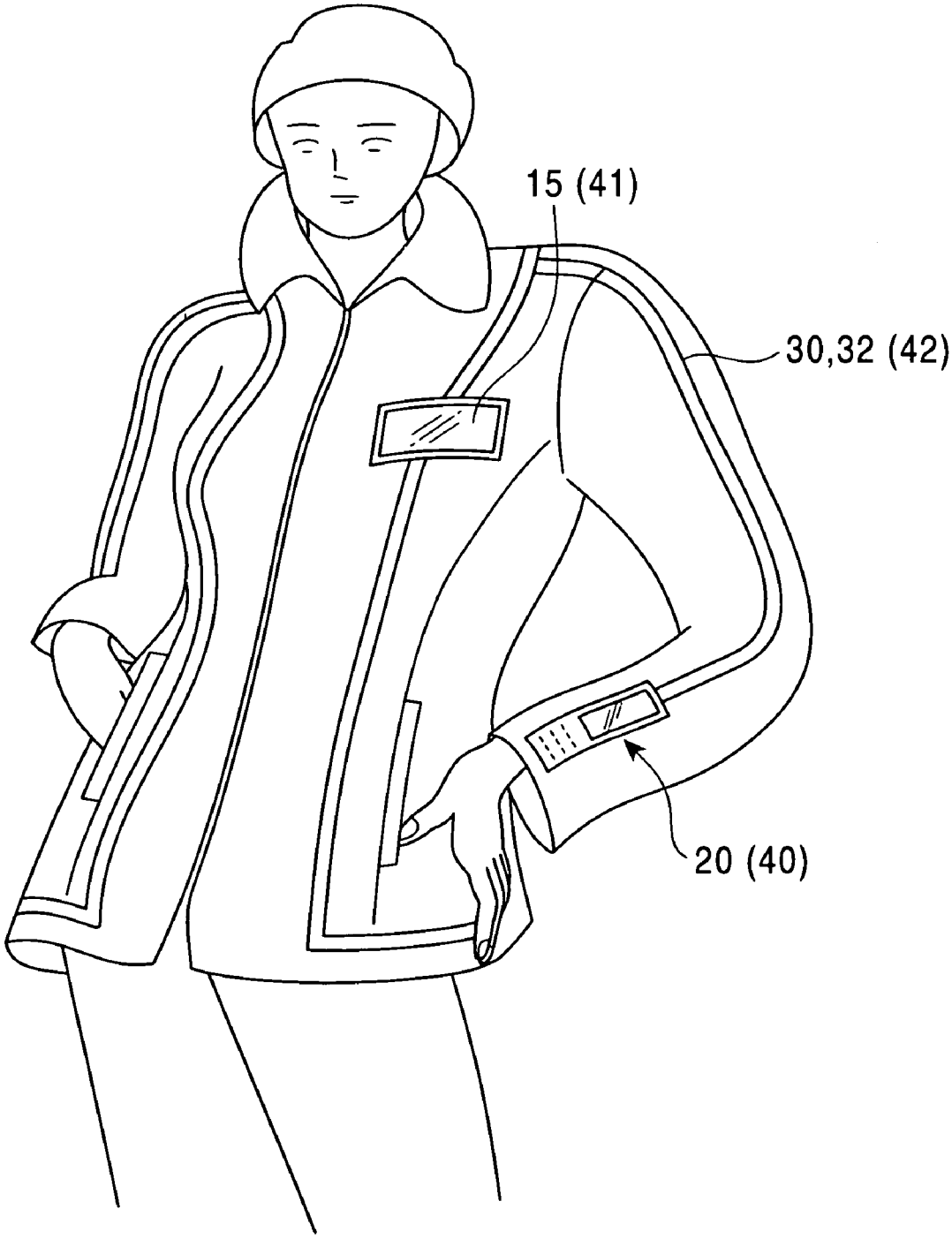
FIG. 13 is a diagram showing an appearance of the image display apparatus shown in FIG. 12 is mounted on clothes.

FIG. 13 shows an example in which the image display apparatus according to the present invention shown in FIG. 10 to FIG. 12 is mounted on clothes.

In FIG. 13, the image display section 15 or 41 is installed on the chest part of the clothes, and the display drive section 20 or the image data signal generation section 40 is installed on the sleeve sections. The assembly of the optical cables 33 of the optical cable units 30 and 32 or the signal relay section 42 and the earth wire 35, including the optical cable for connecting the image display section 15 or 41 and the display drive section 20, or the image data signal generation section 40, exists on the clothes. The assembly of the optical cable 33 and the earth wire 35 may be over woven into the clothes.

It is also possible to weave the earth wire 35 into the clothes, and the optical cable 33 is embedded therein.

It is also possible to use the optical cable unit, that is, the signal relay section, for connection between the input section 10 and the data processing section 9, which is effective to relay signals without being adversely influenced by static electricity when an electric connection is made between elements distant from each other.

This application is based on Japanese Patent Applications Nos. 2001-106011, 2001-332338 and 2001-401363 which are hereby incorporated by reference.

What is claimed is:

1. An image display comprising:

at least one image display panel which is to be attached to a cloth and can be freely bent along said cloth, and a drive section which is electrically connected to said at least one image display panel and drives said at least one image display panel, said drive section having an antenna which transmits or receives a communication signal;

wherein each of said at least one image display panel includes a light emitting layer having an organic electroluminescence layer, and groups of data electrodes and scanning electrodes, said group of data electrodes and said group of scanning electrodes respectively crossing each other and sandwiching said light emitting layer therebetween to form a matrix of controllable pixels.

2. The image display according to claim 1, wherein said at least one image display panel further includes means for detachably adhering to said cloth.

3. The image display according to claim 2, wherein said at least one image display panel and said drive section are connected via a connector.

4. The image display according to claim 1, wherein said at least one image display panel is an organic electro-luminescence panel.

5. The image display according to claim 1, wherein said at least one image display panel is attached to at least one location of a chest section, sleeve section and rear section of said cloth.

6. The image display according to claim 1, wherein said drive section is flexible.

7. The image display according to claim 1 further comprising an input section which allows inputting of instructions to the drive section.

8. The image display according to claim 7 further comprising a cable for connecting said at least one image display panel to the input section, and said cable includes at least one optical cable and at least one earth wire.

9. The image display according to claim 8, wherein said cable is a twist of said at least one optical cable and said at least one earth wire.

10. The image display according to claim 1 further comprising a storage which stores the communication signal received at the antenna.

11. The image display according to claim 10 further comprising a speaker which outputs information contained in the communication signal stored in the storage.

12. The image display according to claim 1, wherein the image display panel displays information contained in the communication signal under the control of the drive section.

13. The image display according to claim 1 further comprising a cable having at least one optical cable and at least one earth wire, wherein said at least one image display panel includes a first display panel and a second display panel, and the first display panel is connected to the second display panel by the cable.

14. The image display according to claim 13, wherein said cable is a twist of said at least one optical cable and said at least one earth wire.

15. A cloth comprising:

a fabric;

at least one bendable image display panel attached to the fabric, each said image display panel including a light emitting layer having an organic electroluminescence layer, a group of data electrodes and a group of scanning electrodes, said group of data electrodes and said group of scanning electrodes crossing each other and sandwiching said light emitting layer therebetween to form a matrix of controllable pixels; and a drive section electrically connected to said at least one image display panel for driving said at least one image display panel, said drive section having an antenna to transmit or receive a communication signal.

16. The cloth according to claim 15 further comprising an input section which allows inputting of instructions to the drive section.

17. The cloth according to claim 16 further comprising a cable for connecting said at least one image display panel to the input section, and said cable includes at least one optical cable and at least one earth wire.

18. The cloth according to claim 17, wherein said cable is a twist of said at least one optical cable and said at least one earth wire.

19. The cloth according to claim 15 further comprising a storage which stores the communication signal received at the antenna.

20. The cloth according to claim 19 further comprising a speaker which outputs information contained in the communication signal stored in the storage.

21. The cloth according to claim 15, wherein the at least one image display panel displays information contained in the communication signal under the control of the drive section.

22. The cloth according to claim 15 further comprising a cable having at least one optical cable and at least one earth wire, wherein said at least one image display panel includes a first display panel and a second display panel, and the first display panel is connected to the second display panel by the cable.

23. The cloth according to claim 22, wherein said cable is a twist of said at least one optical cable and said at least one earth wire.

24. The cloth according to claim 15 further comprising means for detachably attaching each said image display panel to the fabric.

25. The cloth according to claim 15, wherein said at least one image display panel is connected to said drive section via a connector.

26. The cloth according to claim 15, wherein each said image display panel includes an organic electroluminescence panel.

27. The cloth according to claim 15, wherein said at least one image display panel is attached to a chest section, sleeve section or rear section of the cloth.

28. The cloth according to claim 15, wherein said drive section is flexible.

* * * * *